US006267493B1

(12) United States Patent
Swisher, Jr. et al.

(10) Patent No.: US 6,267,493 B1
(45) Date of Patent: Jul. 31, 2001

(54) DRUM MIXER HAVING A PLURALITY OF ISOLATED AGGREGATE TRANSPORT CHANNELS

(75) Inventors: George W. Swisher, Jr., Oklahoma City; Jianmin Zhang, Norman, both of OK (US)

(73) Assignee: CMI Corporation, Oklahoma City, OK (US)

( * ) Notice: Subject to any disclaimer, the term of this patent is extended or adjusted under 35 U.S.C. 154(b) by 0 days.

(21) Appl. No.: 09/324,248

(22) Filed: Jun. 2, 1999

(51) Int. Cl.[7] ..... B28C 5/46

(52) U.S. Cl. ..... 366/25; 34/137; 432/111

(58) Field of Search ..... 366/7, 22–25; 34/135, 136, 137; 432/105, 106, 108, 110, 111, 117, 118

(56) References Cited

U.S. PATENT DOCUMENTS

| | | |
|---|---|---|
| Re. 30,685 | 7/1981 | Mendenhall . |
| Re. 31,904 | 6/1985 | Mendenhall . |
| Re. 31,905 | 6/1985 | Mendenhall . |
| 1,187,959 | 6/1916 | Ash . |
| 1,216,667 | 2/1917 | Downs . |
| 1,444,794 | 2/1923 | Kernan . |
| 1,524,397 | 1/1925 | Jones . |

(List continued on next page.)

FOREIGN PATENT DOCUMENTS

| | | | |
|---|---|---|---|
| 1121749 | 4/1982 | (CA) . | |
| 3628106 * | 2/1988 | (DE) | 366/25 |
| 24755 * | 3/1981 | (EP) | 366/25 |
| 8105677 | 12/1981 | (NL) . | |

OTHER PUBLICATIONS

Title: "How To Burn Salty Sludges" By: Clarence J. Wall, John T. Graves and Elliot J. Roberts p: 6 Publication: Chemical Engineering, Apr. 14, 1975.

(List continued on next page.)

*Primary Examiner*—Charles E. Cooley
(74) *Attorney, Agent, or Firm*—Dunlap, Codding & Rogers, P.C.

(57) ABSTRACT

A drum mixer for heating, mixing and drying an aggregate material, such as a mixture of recycled asphaltic pavement and virgin aggregate. The drum mixer includes an inclined drum having a first end and a second end. The drum forms a pre-heating/blending section adjacent the first end, a heating/mixing section adjacent the second end, and a heating/drying/mixing section therebetween. A feed assembly for feeding aggregate material, preferably having a high ratio of RAP material to virgin aggregate, is provided. The feed assembly feeds the aggregate material into the pre-heating/blending section of the drum for movement of the aggregate material sequentially through the pre-heating/blending section, the heating/drying/mixing section and the heating/mixing section. A burner assembly extends from the second end of the drum into the heating/drying/mixing section of the drum. The burner assembly creates a high temperature gas stream which flows through the heating/drying/mixing and pre-heating/blending sections of the drum. Longitudinally extending tubular compartments are positioned in the heating/drying/mixing section of the drum so as to define a plurality of longitudinally-extending aggregate transporting channels. The aggregate transporting channels within the tubular compartments are out of direct contact with the high temperature gas stream while the tubular compartments are exposed to the high temperature gas stream. Thus, the aggregate material is heated, and dried indirectly by the high temperature gas stream as the aggregate material passes through the aggregate transporting channels.

27 Claims, 4 Drawing Sheets

U.S. PATENT DOCUMENTS

| | | | |
|---|---|---|---|
| 1,731,898 | | 10/1929 | Heine . |
| 1,754,854 | | 4/1930 | Gelstharp . |
| 1,904,781 | | 4/1933 | Crawford . |
| 1,959,061 | * | 5/1934 | Perkins . |
| 2,049,734 | | 8/1936 | Fasting . |
| 2,063,233 | | 12/1936 | Debuch . |
| 2,252,279 | | 8/1941 | Zirngibl et al. . |
| 2,348,446 | * | 5/1944 | Becker . |
| 2,354,747 | | 8/1944 | Epstein et al. . |
| 2,590,090 | | 3/1952 | DeVaney . |
| 2,602,388 | | 7/1952 | Elliott et al. . |
| 2,654,592 | | 10/1953 | Harris . |
| 2,775,174 | | 12/1956 | Petrick . |
| 2,967,094 | | 1/1961 | Mitchell . |
| 3,087,715 | | 4/1963 | Dailey, Jr. . |
| 3,195,608 | | 7/1965 | Voorheis et al. . |
| 3,215,501 | | 11/1965 | Phillips . |
| 3,452,690 | | 7/1969 | Tarbox et al. . |
| 3,488,700 | | 1/1970 | Iken et al. . |
| 3,604,375 | | 9/1971 | Bruns et al. . |
| 3,687,646 | | 8/1972 | Brent et al. . |
| 3,693,945 | | 9/1972 | Brock . |
| 3,705,711 | | 12/1972 | Seelandt et al. . |
| 3,714,038 | | 1/1973 | Marsh . |
| 3,725,538 | | 4/1973 | Brewer . |
| 3,845,941 | * | 11/1974 | Mendenhall . |
| 3,848,548 | | 11/1974 | Bolejack, Jr. et al. . |
| 3,866,888 | | 2/1975 | Dydzky . |
| 3,893,810 | | 7/1975 | Lientz . |
| 3,971,666 | | 7/1976 | Mendenhall . |
| 3,975,002 | | 8/1976 | Mendenhall . |
| 3,999,743 | | 12/1976 | Mendenhall . |
| 4,000,000 | | 12/1976 | Mendenhall . |
| 4,034,968 | | 7/1977 | Mendenhall . |
| 4,066,247 | | 1/1978 | Mendenhall . |
| 4,067,552 | | 1/1978 | Mendenhall . |
| 4,074,894 | | 2/1978 | Mendenhall . |
| 4,095,284 | | 6/1978 | Mendenhall . |
| 4,096,588 | | 6/1978 | Mendenhall . |
| 4,104,736 | | 8/1978 | Mendenhall . |
| 4,106,110 | | 8/1978 | Mendenhall . |
| 4,126,397 | | 11/1978 | Mendenhall . |
| 4,136,966 | | 1/1979 | Mendenhall . |
| 4,143,803 | | 3/1979 | Mendenhall . |
| 4,153,471 | | 5/1979 | Mendenhall . |
| 4,171,950 | | 10/1979 | Bliemeister . |
| 4,177,080 | | 12/1979 | Mendenhall . |
| 4,182,631 | | 1/1980 | Mendenhall . |
| 4,189,238 | | 2/1980 | Mendenhall . |
| 4,208,131 | | 6/1980 | Mendenhall . |
| 4,211,490 | | 7/1980 | Brock et al. . |
| 4,215,941 | | 8/1980 | Mendenhall . |
| 4,219,278 | | 8/1980 | Mendenhall . |
| 4,240,754 | | 12/1980 | Mendenhall . |
| 4,256,506 | | 3/1981 | Mendenhall . |
| 4,265,546 | | 5/1981 | Mendenhall . |
| 4,293,228 | * | 10/1981 | Swisher, Jr. et al. ..... 366/25 |
| 4,298,287 | | 11/1981 | McCarter et al. . |
| 4,309,113 | | 1/1982 | Mendenhall . |
| 4,332,206 | | 6/1982 | Tucker et al. . |
| 4,338,868 | | 7/1982 | Lientz . |
| 4,382,682 | | 5/1983 | Mendenhall . |
| 4,387,996 | | 6/1983 | Mendenhall . |
| 4,398,826 | | 8/1983 | Mendenhall . |
| 4,420,901 | | 12/1983 | Clarke . |
| 4,424,755 | | 1/1984 | Caffyn et al. . |
| 4,427,376 | * | 1/1984 | Etnyre et al. ..... 432/105 |
| 4,427,377 | | 1/1984 | Dambrine et al. . |
| 4,429,642 | | 2/1984 | Deve . |
| 4,439,040 | | 3/1984 | Mendenhall . |
| 4,481,039 | | 11/1984 | Mendenhall . |
| 4,519,990 | | 5/1985 | Bevilaqua et al. . |
| 4,548,530 | | 10/1985 | Whitman . |
| 4,555,182 | | 11/1985 | Mendenhall . |
| 4,575,336 | | 3/1986 | Mudd et al. . |
| 4,648,333 | | 3/1987 | Mudd et al. . |
| 4,667,609 | | 5/1987 | Hardison et al. . |
| 4,700,638 | | 10/1987 | Przewaiski . |
| 4,782,625 | | 11/1988 | Gerken et al. . |
| 4,827,854 | | 5/1989 | Collette . |
| 4,859,177 | | 8/1989 | Kreisberg et al. . |
| 4,919,538 | * | 4/1990 | Swisher, Jr. ..... 366/25 |
| 4,925,389 | | 5/1990 | DeCicco et al. . |
| 4,955,986 | | 9/1990 | Maury et al. . |
| 4,957,429 | | 9/1990 | Mendenhall . |
| 4,988,207 | * | 1/1991 | Marconnet ..... 366/25 |
| 5,083,870 | | 1/1992 | Sindelar et al. . |
| 5,085,581 | | 2/1992 | Mendenhall . |
| 5,240,412 | | 8/1993 | Mendenhall . |
| 5,305,533 | | 4/1994 | Alexander et al. . |
| 5,305,696 | | 4/1994 | Mendenhall . |
| 5,364,182 | * | 11/1994 | Hawkins ..... 366/25 |
| 5,558,432 | * | 9/1996 | Swisher, Jr. ..... 366/25 |
| 5,772,317 | * | 6/1998 | Butler ..... 366/7 |

OTHER PUBLICATIONS

Title: Principles of Construction of Hot–Mix Asphalt Pavements p: 6 Publication: Asphalt Institute, Series No. 22, Jan. 1983.

Title: "Seven Years Experience in Thermal Soil Treatment" By: Rudolf C. Reintjes and Cees Schuler Ecotechniek by, Utracht the Netherlands p:11 Forum on Innovative Hazardous Waste Treatment Technologies: Domestic and International Date: Jun. 1989.

Title: "Consider Fluid–Bed Incineration for Hazardous Waste Destruction" By: John F. Mullen p: 9 Publication: Chemical Engineering Process, Jun. 1992.

* cited by examiner

DRUM MIXER HAVING A PLURALITY OF ISOLATED AGGREGATE TRANSPORT CHANNELS

BACKGROUND OF THE INVENTION

Drum mixers for manufacturing asphaltic compositions out of an aggregate material are known in the art. An aggregate material known as "recycled asphaltic pavement" (RAP) is an inexpensive and plentiful aggregate material which can be used to manufacture an asphaltic composition. The RAP material is formed from a mixture of an asphaltic material, aggregates and mineral binder or "fines".

Virgin aggregates can also be used in manufacturing asphaltic compositions. As the virgin aggregate flows through the drum mixer, it is combined with liquid asphalt and fines to produce the asphalt composition. However, producing an asphaltic composition from virgin aggregate is more expensive than producing the asphaltic composition from RAP material because the virgin aggregate is more costly than the RAP material, and more asphaltic material must be added to the virgin aggregate.

When RAP material has been used in previous drum mixers, the RAP material was introduced into the drum mixer in a different location separate from the virgin aggregate to minimize what is known in the art as "blue smoke" and also to not degrade the RAP material. And, as a practical matter, the ratio of RAP material which could be used relative to virgin aggregate was about 25% with maximums up to 50% in some cases. Thus, it has been necessary to use a substantial amount of expensive virgin aggregate in producing the asphaltic composition.

By increasing the ratio of RAP material to virgin aggregate, the costs of manufacturing the asphaltic composition can be significantly reduced. It is to such a drum mixer for manufacturing an asphaltic composition out of a high ratio of RAP material to virgin aggregate material that the present invention is directed.

SUMMARY OF THE INVENTION

The present invention is a drum mixer for heating, mixing and drying an aggregate material, such as a mixture of recycled asphaltic pavement and virgin aggregate. The drum mixer includes an inclined drum having a first end and a second end. The drum forms a pre-heating/blending section adjacent the first end, a heating/mixing section adjacent the second end, a heating/drying/mixing section therebetween, and a discharge outlet adjacent the second end.

A feed assembly for feeding aggregate material is provided. The feed assembly feeds the aggregate material into the pre-heating/blending section of the drum for movement of the aggregate material sequentially through the preheating/blending section, the heating/drying/mixing section, the heating/mixing section, and the discharge outlet. A burner assembly extends from the second end of the drum into the heating/drying/mixing section of the drum. The burner assembly creates a high temperature gas stream which flows through the heating/drying/mixing and preheating/blending sections of the drum.

Tubular compartments are positioned in the heating/drying/mixing section of the drum so as to form a plurality of aggregate transporting channels. The aggregate transporting channels within the tubular compartments are out of direct contact with the high temperature gas stream while the tubular compartments are exposed to the high temperature gas stream. Thus, the aggregate material is heated, and dried indirectly via conduction of heat through the tubular compartments as the aggregate material passes through the aggregate transporting channels.

In some aspects of the present invention, the drum mixer may also include one or more fluid injectors and fines injectors, both of which communicate with the drum for injecting an asphaltic fluid, fines or other additives, such as fibers or anti-strip agents into the drum so that the asphaltic fluid, fines or other additives are mixed with the aggregate material to form the asphaltic composition.

DETAILED DESCRIPTION OF THE PREFERRED EMBODIMENTS OF THE INVENTION

Figure 1:
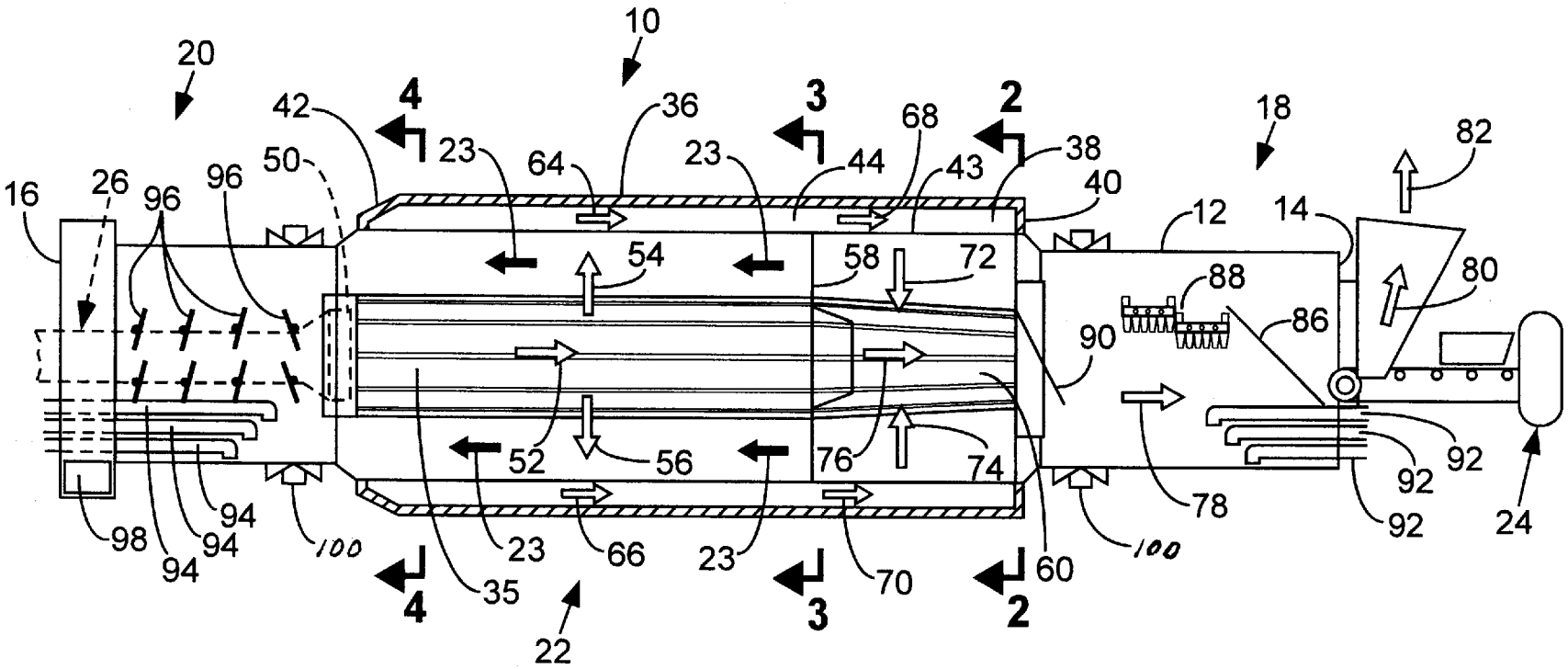
FIG. 1 is a schematic view of a drum mixer constructed in accordance with the present invention.

Referring now to the drawings and in particular to FIG. 1, shown therein is a drum mixer 10 constructed in accordance with the present invention, for heating, drying and mixing of aggregate material (not shown) in high-temperature desorption applications. One use of the present invention is for manufacturing asphaltic compositions out of a variable ratio of a mixture of recycled asphaltic pavement (RAP material) and virgin aggregate. When used for manufacturing asphaltic compositions, the ratio of RAP material and virgin aggregate in the mixture can be varied between 100% RAP material to 0% virgin aggregate, and 0% RAP material to 100% virgin aggregate without any modification to the drum mixer 10.

The drum mixer 10 includes an inclined drum 12 which has a first end 14 and a second end 16. The drum 12 forms a preheating/blending section 18, a mixing/heating section 20 and a mixing/heating/drying section 22. The drum 12 is inclined such that the section 18 is raised above the section 20 so that the aggregate material moving through the drum 12 flows toward the section 20. The angle of the incline can be adjusted via any suitable mechanical assembly, such as adjustable hydraulic supports (not shown). The aggregate material passing through the drum 12 is indicated in FIG. 1 by the arrows 23.

The section 18 is disposed adjacent the first end 14 of the drum 12. The section 20 is disposed adjacent the second end 16 of the drum 12. The section 22 is disposed between the section 18 and the section 20.

The drum mixer 10 is also provided with a feeder assembly 24. The feeder assembly 24 serves to feed aggregate material into the first end 14 of the inclined drum 12 for movement of the aggregate material sequentially through the section 18, the section 22, and the section 20. The feeder assembly 24 can be any suitable feeder assembly, such as a screw auger, a chute, or a fast-moving conveyor belt which projects the aggregate material through the first end 14 of the inclined drum 12 and thereby into the section 18.

The drum mixer 10 is also provided with a burner assembly 26. The burner assembly 26 is shown in dashed lines in FIG. 1. The burner assembly 26 extends from the second end 16 of the inclined drum 12 and into the section 22 of the inclined drum 12. When ignited, the burner assembly 26 creates a high temperature gas stream to radiantly, convectively and conductively heat the interior of the drum 10. The high temperature gas stream flows through the section 22 and the section 18, so as to indirectly heat the aggregate material as the aggregate material passes through the section 22 and to come into contact with and thereby directly heat the aggregate material as the material travels through the section 18.

Figure 2:
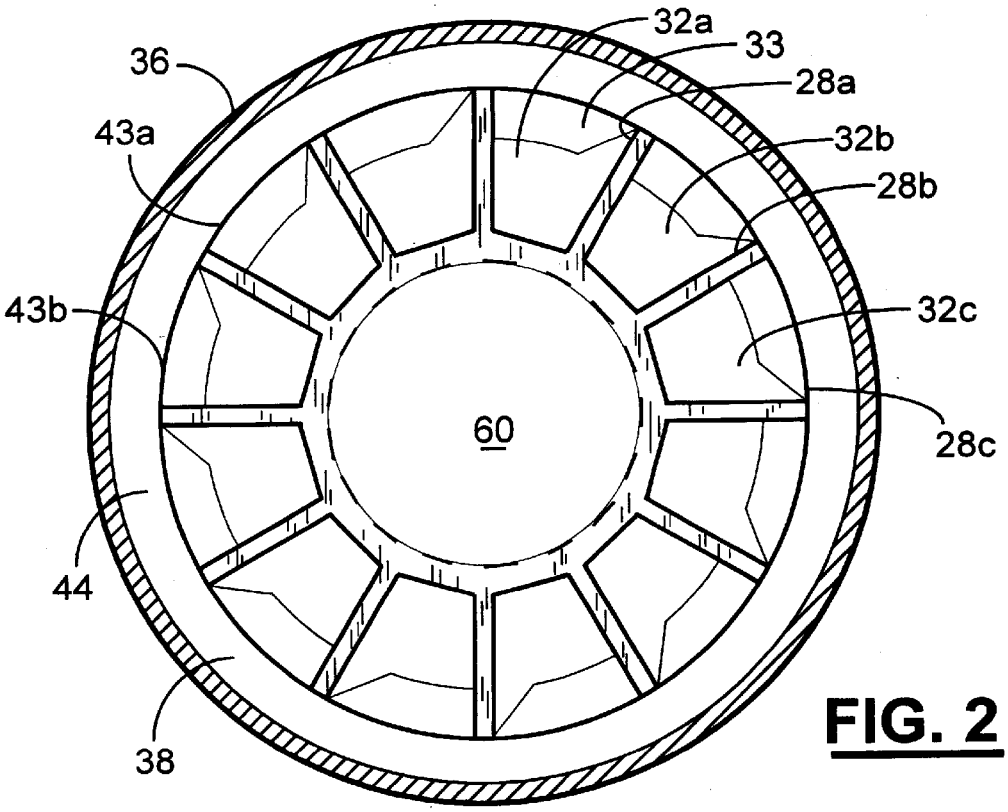
FIG. 2 is a cross-sectional view of the drum mixer taken along lines 2—2 in FIG. 1.
Figure 3:
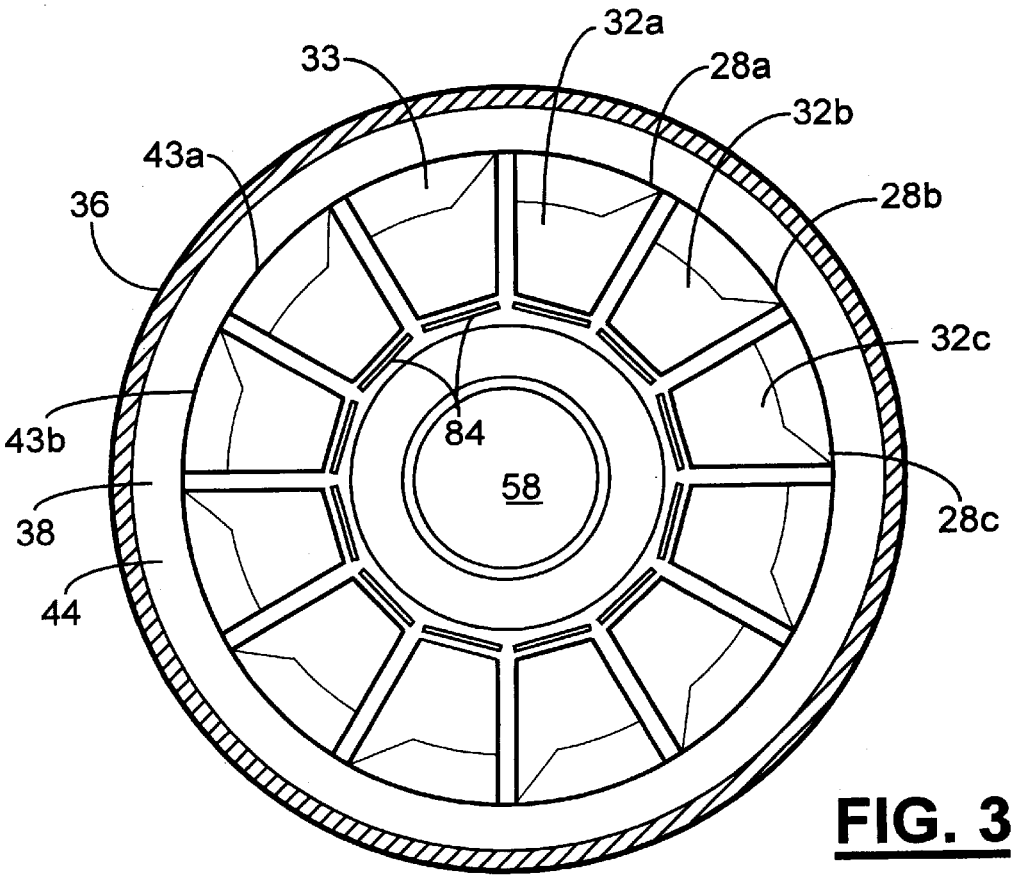
FIG. 3 is a cross-sectional view of the drum mixer taken along lines 3—3 of FIG. 1.
Figure 4:
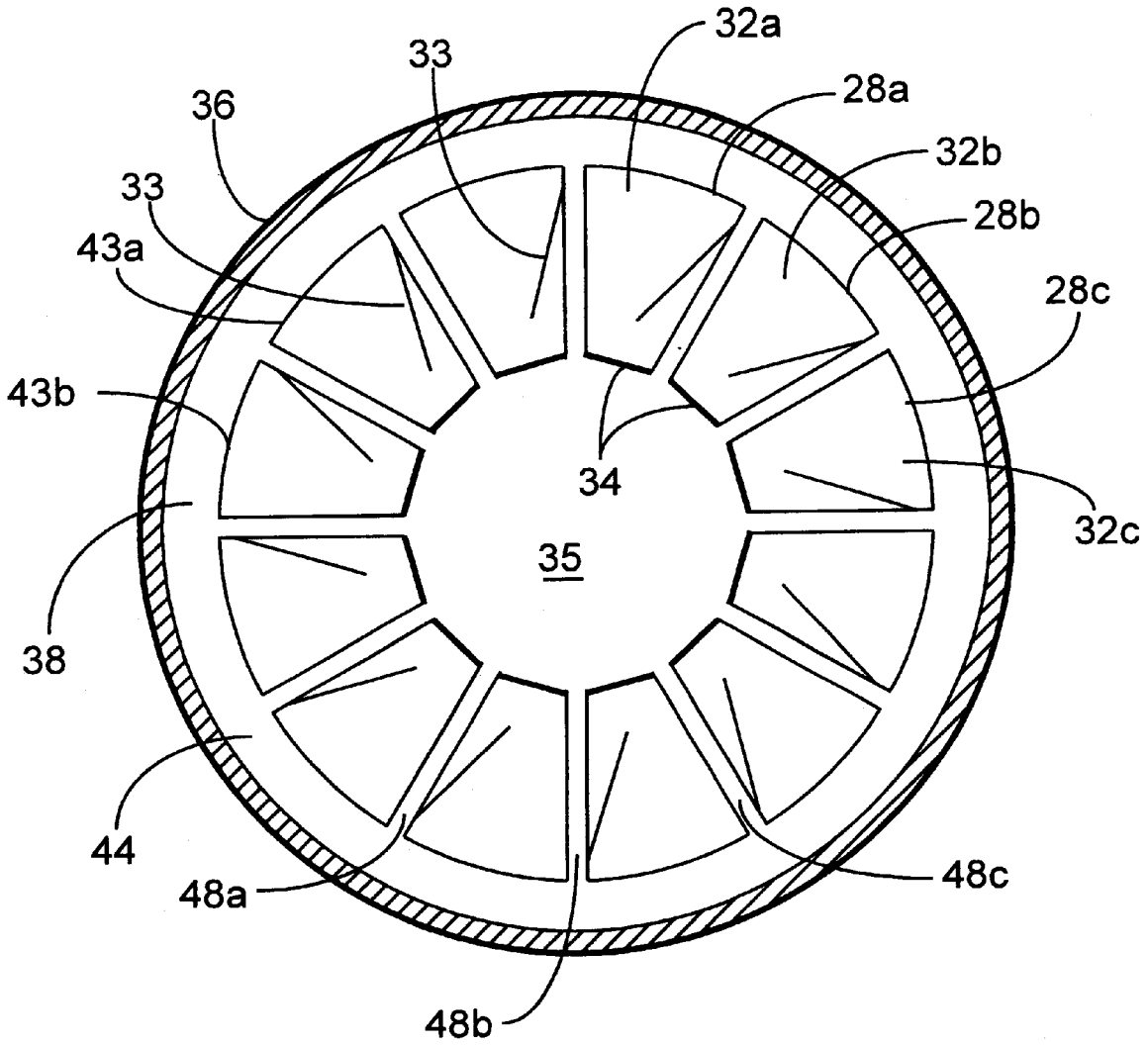
FIG. 4 is a cross-sectional view of the drum mixer taken along lines 4—4 of FIG. 1.

As best shown in the cross-sectional views of FIGS. 2, 3 and 4, a plurality of tubular compartments 28, which are constructed of a heat conductive material such as stainless steel, is supported in the section 22 of the inclined drum 12. Although twelve tubular compartments 28 are depicted in FIGS. 2, 3 and 4, for purposes of clarity, only three tubular compartments 28 are labeled as 28*a*, 28*b*, and 28*c*. It will be understood that twelve tubular compartments 28 are shown in FIGS. 2, 3 and 4 by way of example only, and more or fewer tubular compartments 28 can be used in practicing the present invention. The tubular compartments 28 define a plurality of aggregate transporting channels 32, only three of which are labeled for purposes of clarity in FIGS. 2, 3, and 4 by the reference numerals 32*a*, 32*b* and 32*c*.

The tubular compartments 28 extend longitudinally through at least a portion of the section 22 of the drum 12. The tubular compartments 28 are exposed to the high temperature gas stream and are thereby directly heated by the high temperature gas stream. Each of the tubular compartments 28 defines an aggregate transporting channel 32, within the tubular compartments 28, such that at least a portion of each of the aggregate transporting channels 32 are isolated from the other aggregate transporting channels 32. The aggregate transporting channels 32, within the tubular compartments, are out of direct contact with the high temperature gas stream produced by the burner assembly 26. Thus the aggregate material passing through the aggregate transporting channels 32 is heated indirectly by the high temperature gas stream via conduction through the heat conductive tubular compartments 28 as the aggregate material passes through the aggregate transporting channels 32. A plurality of flights 33 may be supported within the aggregate transporting channels 32 so as to move the aggregate material through the aggregate transporting channels 32 and into the section 20 of the drum 12 as the drum 12 rotates.

The tubular compartments 28 are circumferentially positioned so that interior surfaces 34 (FIG. 4) on the tubular compartments 28 surround and define an internal combustion chamber 35 (FIGS. 1 and 4) within the drum 12. The combustion chamber 35 is positioned in the section 22 to receive the high temperature gas stream produced by the burner assembly 26. The drum mixer 10 also includes an outer shell 36 which surrounds the tubular compartments 28 in the section 22. The outer shell 36 is constructed of a thermally insulating material such as a ceramic material encompassed by an outer metal hull (not shown).

The outer shell 36 defines a longitudinally extending cavity 38 therein. The outer shell 36 includes a first inwardly extending annular shoulder portion 40 (FIG. 1) and a second inwardly extending annular shoulder portion 42 (FIG. 1).

The tubular compartments 28 are provided with exterior surfaces 43. Only two of the exterior surfaces 43 are labeled as 43*a* and 43*b* for purposes of clarity in FIGS. 2, 3 and 4. The first and second shoulder portions 40 and 42 matingly engage the exterior surfaces 43 of the tubular compartments 28 so as to form a seal therebetween, whereby the outer shell 36 rotate with the drum and a longitudinally extending annular flue gas exhaust passageway 44 is formed in between the exterior surfaces 43 of the tubular compartments 28, and the outer shell 36. The annular flue gas exhaust passageway 44 extends in between the first shoulder portion 40, and the second shoulder portion 42 of the outer shell 36. The outer shell 36 rotates or moves with the inclined drum 12 as the inclined drum 12 is rotated.

Figure 5:
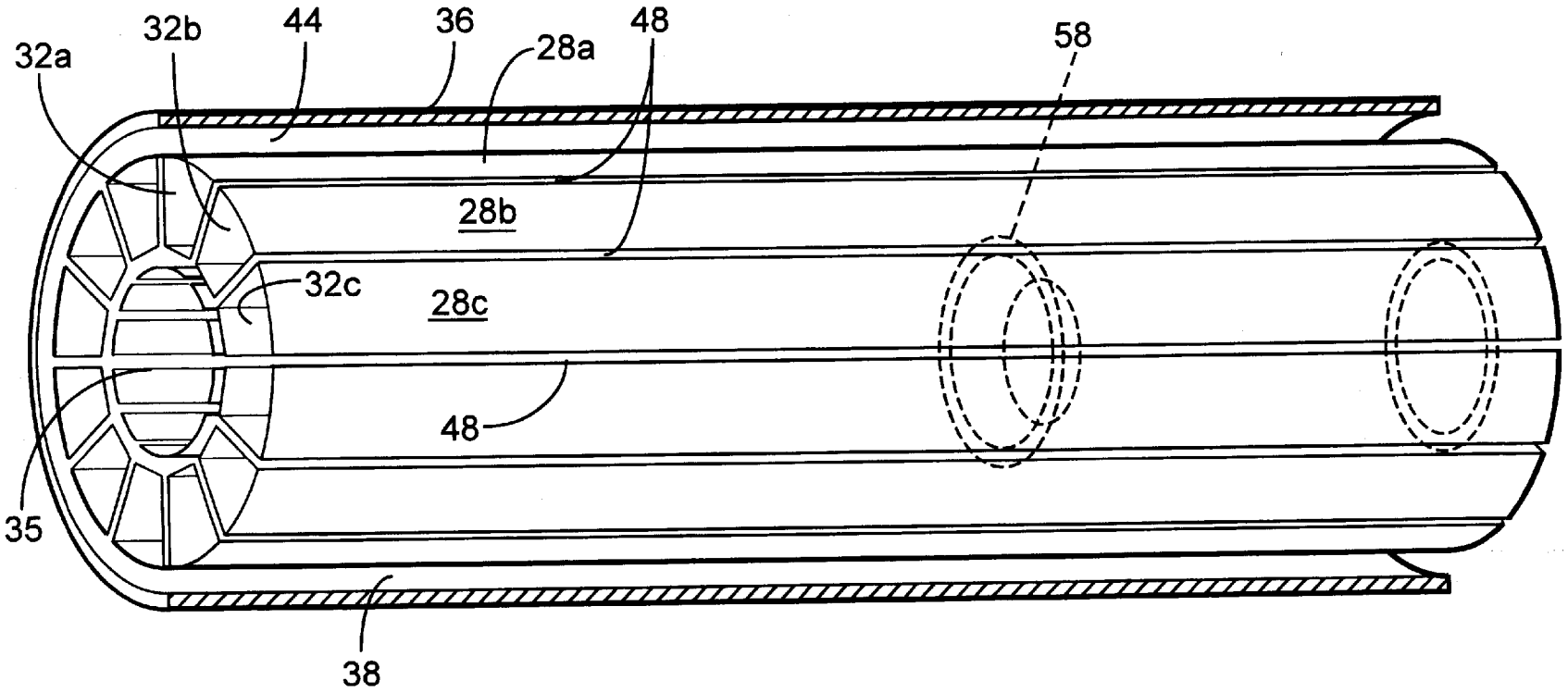
FIG. 5 is a partial, perspective view of a mixing/heating/drying section of the drum mixer depicted in FIG. 1.

As best shown in FIGS. 4 and 5, the tubular compartments 28 are suspended in a spaced-apart relationship to form a plurality of flue gas exhaust channels 48 extending therebetween. Although twelve exhaust channels 48 are depicted in FIG. 4, only three of the flue gas exhaust channels 48 have been labeled in FIG. 4 with the reference numerals 48*a*, 48*b* and 48*c* for purposes of clarity. In general, each flue gas exhaust channel 48 is disposed between a pair of adjacently disposed tubular compartments 28. The flue gas exhaust channels 48 are arranged to receive the high temperature gas stream from the combustion chamber 35 and to discharge the high temperature gas stream into the annular flue gas exhaust passageway 44. The flue gas exhaust channels 48 extend substantially the entire longitudinal length of the tubular compartments 28. The flue gas exhaust channels 48 extend radially outwardly from the combustion chamber 35.

As best shown in FIG. 1, the burner assembly 26 of the drum mixer 10 includes a burner head 50 positioned adjacent to or within the combustion chamber 35 to inject the high temperature gas stream into the combustion chamber 35 as indicated by the arrow 52. The high temperature gas stream travels from the combustion chamber 35 radially outwardly into the flue gas exhaust channels 48 as indicated by the arrows 54 and 56, and into the annular flue gas passageway 44 so that the high temperature gas stream surrounds the tubular compartments 28 thereby heating all sides of the tubular compartments 28.

The drum mixer 10 also includes a flue gas diverter 58 (FIGS. 1, 3 and 5) which is positioned adjacent the combustion chamber 35 and the flue gas exhaust channels 48 so as to substantially partition the cavity formed by the interior surfaces 34 of the tubular compartments 28 into the combustion chamber 35 and an exhaust passageway 60 (FIGS. 1 and 2). The combustion chamber 35 is positioned to receive the high temperature gas stream directly form the burner head 50 of the burner assembly 26. The flue gas diverter 58 diverts the high temperature gas stream radially outwardly into the annular flue gas exhaust passageway 44 (as indicated by the arrows 54 and 56) so that the diverted high temperature gas stream travels past the flue gas diverter 58 as indicated by arrows 64, 66, 68 and 70. The diverted high temperature gas stream then travels radially inwardly through the flue gas exhaust channels 48 (as indicated by the arrows 72 and 74) and into the exhaust passageway 60. The diverted high temperature gas stream is then discharged into the section 18 of the drum 12 as indicated by the arrows 76 and 78, so as to directly heat the aggregate material passing through the section 18. The high temperature gas stream is then discharged out of the first end 14 of the drum 12 and into a filtration system as indicated by the arrows 80 and 82.

As shown in FIG. 3, a plurality of spatially disposed slots 84 is formed through the flue gas diverter 58 so that a portion of the high temperature gas stream passes directly from the combustion chamber 35 to the exhaust passageway 60, so that the high temperature gas stream heats those portions of the drum 12 disposed adjacent the flue gas diverter 58. Although twelve slots 84 are shown in FIG. 3, only two of the slots 84 have been labeled in FIG. 3 for purposes of clarity and more or fewer slots 84 can be utilized in practicing the present invention.

Referring again to FIG. 1, the section 18 of the drum 12 will be described in more detail. A first set of flights 86, a second set of flights 88, and a third set of flights 90 are supported within the section 18 of the drum 12. Only one flight in each of the first and third sets 86 and 90 is shown and only two flights in the second set 88 are shown, for purposes of clarity. It will be understood that a plurality of flights is disposed in each of the first, second and third sets 86, 88 and 90 such that the flights in each set extend circumferentially about the interior of the section 18.

The flights in the first set 86 can be conventional "kicker" flights. The kicker flights in the first set 86 serve to move the aggregate material into the section 18 and generally toward the second set of flights 88.

The flights in the second set 88 can be conventional "lift" flights, which serve to lift the aggregate material from the bottom of the drum 12 to the top thereof as the drum 12 rotates so that the aggregate material will fall from the top of the drum 12 in a veil in a manner well known in the art to more effectively heat the aggregate material by direct contact with the high temperature gas stream.

The flights in the third set 90 may be conventional "kicker" flights which serve to guide the aggregate material into the aggregate transporting channels 32.

One or more injectors 92 can be disposed through the first end 14 of the drum 12 for injecting additives into the drum 12. Three injectors 92 are shown in FIG. 1 by way of example. The additives can be fines, dust, fibers, asphaltic fluids, or other additives known in the art.

The section 20 of the drum mixer 10 will now be described in more detail. The drum mixer 10 may also include one or more injectors 94 extending into the drum 12 from the second end 16 for injecting additives into the drum 12. Three injectors 94 are shown in FIG. 1 by way of example. For example, one of the injectors 94 can be a fluid injector for injecting asphaltic fluid, and two of the injectors can be fines injectors for injecting mineral filler and/or dust into the drum 12.

A plurality of rotatable dams 96 is supported within the section 20 of the drum 12 for advancing or retarding the flow of the aggregate material and/or any additives through the section 20 for a shorter or longer retention time within the section 20. As shown in FIG. 1, the injectors 94 may inject the additives into the section 20 near the section 22 so that the additives will be thoroughly mixed and heated with the aggregate material as the aggregate material moves through the section 20.

A discharge chute 98 is provided on the second end 16 of the drum 12 for discharging the composition formed from the aggregate materials and additives. The high temperature gas stream flows in an opposite direction with respect to the aggregate material as the aggregate material passes through the drum 12. Thus, the temperature of the high temperature gas stream is decreased as the high temperature gas stream imparts energy into the drum 12 as the high temperature gas stream moves toward the first end 14 of the drum 12. When the high temperature gas stream enters into the section 18 of the drum 12, the temperature should be sufficiently low so that the high temperature gas stream will not cause blue smoke or serious product degradation to the aggregate material and/or any additives added thereto. As the high temperature gas stream exits the section 18, the high temperature gas stream is directed into a filtering system, such as a conventional baghouse, for filtering out any particulate material traveling in the high temperature gas stream. To prevent the high temperature gas stream from overheating the filtering system, it is typical for the section 18 to be sized so that the temperature of the high temperature gas stream exiting the section 18 is in a range of about 240° F. to about 400° F.

The inclined drum 12 may be supported on roller supports or "trunions" 100 which may be disposed on either side of the section 22 of the drum 12. The trunions 100 may be mounted onto a trailer (not shown) so that the drum mixer 10 is portable. The drum 12 may be rotated on the trunions 100 by a conventional motor (not shown). It should be noted that the aggregate transporting channels 32, which may be disposed circumferentially in the drum 12, tend to distribute the weight of the aggregate material in the drum 12 evenly about the drum 12 to balance the drum 12. Thus, one skilled in the art will appreciate that the load on the motor or motors rotating the drum 12 is about 50% of the load placed on the motors rotating the conventional drums which lift the aggregate material from the bottom of the drum to the top of the drum with lift flights so that the aggregate material falls from the top of the drum to the bottom in a veil.

The unique design of the inclined drum 12 permits the burner assembly 26 to radiantly, conductively and convectively heat the interior of the drum 12 above a predetermined temperature of about 300° F. so that asphaltic material included in the aggregate material will not adhere to any of the surfaces within the drum 12. Thus, the drum mixer 10 of the present invention is capable of processing aggregate materials including any ratio including a high ratio (above about 50%) of RAP material to virgin aggregate without modification. In fact, the drum mixer 10 of the present invention is capable of processing one hundred percent RAP material thereby substantially reducing the cost of producing the asphaltic composition. In addition, substantially any blue smoke which forms in the drum 12 is incinerated so that the blue smoke does not cause environmental problems.

Changes may be made in the construction and the operation of the various components, elements, and assemblies described herein and changes may be made in the steps or the sequence of steps of the methods described herein without departing from the spirit and the scope of the invention as defined in the following claims.

What is claimed is:

1. A drum mixer for heating, drying and mixing of aggregate material, comprising:

an inclined drum having a first end and a second end, the drum forming a preheating/blending section adjacent said first end, a heating/mixing section adjacent said second end, a heating/drying/mixing section between said preheating/blending section and said heating/mixing section, and a discharge outlet adjacent said second end;

means for feeding aggregate material into the pre-heating/blending section of said drum for movement of the aggregate material sequentially through said preheating/blending section, said heating/drying/mixing section, said heating/mixing section, and said discharge outlet;

a burner assembly extending from said second end into said heating/drying/mixing section for creating a high temperature gas stream flowing through said heating/drying/mixing section and said pre-heating/blending section; and tubular compartments in said heating/drying/mixing section, each of the tubular compartments defining an aggregate transporting channel within the tubular compartment such that at least a portion of each of the aggregate transporting channels is isolated from the other aggregate transporting channels, the aggregate transporting channels extending through at least a portion of said heating/drying/mixing section such that the aggregate transporting channels within the tubular compartments are out of direct contact with the high temperature gas stream and said tubular compartments are exposed to said high temperature gas stream whereby said aggregate material can be heated indirectly by said high temperature gas stream as the aggregate material passes through the aggregate transporting channels.

2. A drum mixer as defined in claim 1, wherein the tubular compartments are arranged to define a combustion chamber to receive said high temperature gas stream produced by said burner assembly.

3. A drum mixer as defined in claim 2, further comprising a thermally insulated outer shell surrounding said tubular compartments.

4. A drum mixer as defined in claim 3, wherein said tubular compartments are spatially disposed so as to form at least one radial exhaust channel arranged to receive said high temperature gas stream from said combustion chamber.

5. A drum mixer as defined in claim 4, wherein said outer shell is spaced from the exterior of said tubular compartments to form an annular passageway therebetween, said annular passageway being arranged to receive said high temperature gas stream from said exhaust channel.

6. A drum mixer as defined in claim 5, further comprising a flue gas diverter positioned within the combustion chamber to divert the high temperature gas stream into the exhaust channel.

7. A drum mixer as defined in claim 6, wherein the flue gas diverter diverts the high temperature gas stream received in said combustion chamber sequentially through said exhaust channel, said annular passageway past said flue gas diverter, back into said exhaust channel, and into an exhaust passageway.

8. A drum mixer as defined in claim 7, wherein the flue gas diverter includes slots to pass a portion of said high temperature gas stream directly from said combustion chamber into said exhaust passageway.

9. A drum mixer as defined in claim 2, further comprising a flue gas diverter positioned adjacent the combustion chamber to form rust passageway separate from said combustion chamber.

10. A drum mixer as defined in claim 9, wherein the flue gas diverter includes slots to pass a portion of said high temperature gas stream directly from said combustion chamber to said exhaust passageway.

11. A drum mixer as defined in claim 2, wherein the burner assembly includes a burner head positioned adjacent the combustion chamber.

12. A drum mixer as defined in claim 1, further comprising a plurality of flights supported within the pre-heating/blending section of the drum so as to move the aggregate material through the pre-heating/blending section and into the aggregate transporting channels in the heating/drying/mixing section of the drum.

13. A drum mixer as defined in claim 1, further comprising:

a fluid injector communicating with the drum for injecting an asphaltic fluid into the drum;

a fines injector communicating with drum so as to inject fines into the drum;

a plurality of dams supported within the heating/mixing section of the drum so as to retard or advance the flow of the aggregate material through the heating/mixing section of the drum.

14. A drum mixer as defined in claim 13, wherein the fluid injector and the fines injector extend through at least one of the first end and the second end of the drum.

15. A drum mixer as defined in claim 1, wherein the aggregate material is about 100% recycled asphaltic pavement material.

16. A drum mixer as defined in claim 1, wherein the aggregate material is about 100% virgin material.

17. A drum mixer as defined in claim 1, wherein the drum is constructed such that the mixture of the aggregate material passed through the drum can be varied between about 100% recycled asphaltic pavement to about 100% virgin material.

18. A drum mixer for manufacturing an asphaltic composition, comprising:

a rotatable drum formed of a heat conductive material, the drum including a pre-heating/blending section, a heating/drying/mixing section, and a heating/mixing section adapted to receive the heated, mixed and dried aggregate material from the heating/drying/mixing section of the drum, the drum including:

an outer thermally insulating tubular shell having an internal surface defining a longitudinally extending cavity therein, the tubular shell including a first inwardly extending annular shoulder portion spaced from a second inwardly extending annular shoulder portion;

a plurality of longitudinally extending tubular compartments suspended in the longitudinally extending cavity defined by the outer shell, each of the tubular compartments defining an interior surface, an exterior surface and an aggregate transporting channel, the first and second inwardly extending annular shoulder portions matingly engaging the exterior surface of the tubular compartments so as to form a seal therebetween whereby the outer insulating tubular shell rotates with the drum and a longitudinally extending annular flue gas exhaust passageway is formed in between the exterior of the tubular compartments, the internal surface of the outer tubular insulating shell, the first inwardly extending annular shoulder portion, and the second inwardly extending annular shoulder portion, the interior surfaces of the tubular compartments cooperating to define a longitudinally extending inner combustion chamber, the tubular compartments being spatially disposed so as to define a plurality of radially extending flue gas exhaust channels in between each pair of tubular compartments;

a flue gas diverter positioned within the combustion chamber defined by the inner shell so as to form an exhaust passageway, the combustion chamber positioned to receive a high temperature gas stream, and the exhaust passageway positioned to discharge a diverted high temperature gas stream into the pre-heating/blending section of the drum;

a burner assembly positioned to eject the high temperature gas stream into the combustion chamber whereby the high temperature gas stream is diverted by the flue gas diverter through the exhaust channels and into the annular passageway to flow past the flue gas diverter, and from the annular passageway into the exhaust passageway via the exhaust channels, and from the exhaust passageway into the pre-heat/blending section of the drum;

a feed assembly communicating with the pre-heating/blending section of the drum so as to selectively inject the aggregate material into the pre-heating/blending section of the drum;

a plurality of flights supported within the pre-heating/blending section of the drum so as to move the aggregate material through the preheating/blending section and into the aggregate transporting channels in the heating/drying/mixing section of the drum;

a fluid injector communicating with the drum for injecting a fluid additive into the drum whereby the injected fluid may be mixed with the aggregate material;

a fines injector communicating with the drum so as to inject fines into the drum;

a plurality of rotatable dams supported within the heating/mixing section of the drum so as to retard or advance the flow of the aggregate material;

means for raising the pre-heating/blending section above the heating/mixing section; and means for selectively rotating the drum.

19. A drum mixer as defined in claim 18, further comprising:

a plurality of flights supported within the aggregate transporting channels so as to move the aggregate material through the aggregate transporting channels and into the heating/mixing section of the drum.

20. A drum mixer for manufacturing an asphaltic composition, comprising:

a rotatable drum formed of a heat conductive material, the drum including a pre-heating /blending section, a heating/drying/mixing section, and a heating/mixing section adapted to receive the heated, mixed and dried aggregate material from the heating/drying/mixing section of the drum, the drum including:

an outer thermally insulating tubular shell having an internal surface defining a longitudinally extending cavity therein, a plurality of longitudinally extending tubular compartments suspended in the longitudinally extending cavity defined by the outer shell, each of the tubular compartments defining an aggregate transporting channel within the tubular compartment such that at least a portion of each of the aggregate transporting channels is isolated from the other aggregate transporting channels, each of the tubular compartments having an interior surface and an exterior surface, the outer thermally insulating tubular shell being spaced a distance from the tubular compartments so as to form a longitudinally extending annular flue gas exhaust passageway in between the exterior surface of the tubular compartments and the internal surface of the outer tubular insulating shell, the interior surfaces of the tubular compartments cooperating to define a longitudinally extending inner combustion chamber, the tubular compartments being spatially disposed so as to define a plurality of flue gas exhaust channels with the each flue gas exhaust channel positioned in between a pair of tubular compartments, whereby the inner combustion chamber communicates with the annular flue gas exhaust passageway through the flue gas exhaust channels;

a plurality of flights supported within the pre-heating/blending section of the drum so as to move the aggregate material through the pre-heating/blending section and into the aggregate transporting channels in the heating/drying/mixing section of the drum;

a flue gas diverter positioned within the combustion chamber defined by the interior surfaces of the tubular compartments so as to form an exhaust passageway, whereby the combustion chamber and the exhaust passageway are substantially separated by the flue gas diverter, the combustion chamber positioned to receive a high temperature gas stream, and the exhaust passageway positioned to discharge a diverted high temperature gas stream into the pre-heating/blending section of the drum;

means for selectively rotating the drum;

a feed assembly communicating with the pre-heating/blending section of the drum so as to selectively inject the aggregate material into the preheating/blending section of the drum; and a burner assembly positioned to eject the high temperature gas stream into the combustion chamber whereby the high temperature gas stream is diverted by the flue gas diverter through the flue gas exhaust channels and into the annular flue gas exhaust passageway to flow past the flue gas diverter, and from the annular flue gas exhaust passageway into the exhaust passageway via the flue gas exhaust channels, and from the exhaust passageway into the preheating/blending section of the drum for directly contacting and thereby pre-heating the asphalt composition injected into the preheating/blending section of the drum.

21. A drum mixer for heating, drying and mixing of aggregate material, comprising:

an inclined drum having a first end and a second end, the drum forming a pre-heating/blending section adjacent said first end, a heating/mixing section adjacent said second end, a heating/drying/mixing section between said pre-heating/blending section and said heating/mixing section, and a discharge outlet adjacent said second end;

means for feeding aggregate material into the pre-heating/blending section of said drum for movement of the aggregate material sequentially through said pre-heating/blending section, said heating/drying/mixing section, said heating/mixing section, and said discharge outlet;

a burner assembly extending from said second end into said heating/drying/mixing section for creating a high temperature gas stream flowing through said heating/drying/mixing section and said pre-heating/blending section; and tubular compartments in said heating/drying/mixing section defining a plurality of aggregate transporting channels extending through at least a portion of said heating/drying/mixing section such that the aggregate transporting channels within the tubular compartments are out of direct contact with the high temperature gas stream and said tubular compartments are exposed to said high temperature gas stream whereby said aggregate material can be heated indirectly by said high temperature gas stream as the aggregate material passes through the aggregate transporting channels, the tubular compartments being arranged to define a combustion chamber to receive said high temperature gas stream produced by said burner assembly, said tubular compartments being spatially disposed so as to form at least one radial exhaust channel arranged to receive said high temperature gas stream from said combustion chamber; and a thermally insulated outer shell surrounding said tubular compartments.

22. The drum mixer of claim 21, wherein said outer shell is spaced from the exterior of said tubular compartments to form an annular passageway therebetween, said annular passageway being arranged to receive said high temperature gas stream from said exhaust channel.

23. The drum mixer of claim 22, further comprising a flue gas diverter positioned within the combustion chamber to divert the high temperature gas stream into the exhaust channel.

24. The drum mixer of claim 23, wherein the flue gas diverter diverts the high temperature gas stream received in said combustion chamber sequentially through said exhaust channel, said annular passageway past said flue gas diverter, back into said exhaust channel, and into an exhaust passageway.

25. The drum mixer of claim 24, wherein the flue gas diverter includes slots to pass a portion of said high temperature gas stream directly from said combustion chamber into said exhaust passageway.

26. A drum mixer for heating, drying and mixing of aggregate material, comprising:

an inclined drum having a first end and a second end, the drum forming a pre-heating/blending section adjacent said first end, a heating/mixing section adjacent said second end, a heating/drying/mixing section between said pre-heating/blending section and said heating/mixing section, and a discharge outlet adjacent said second end;

means for feeding aggregate material into the pre-heating/blending section of said drum for movement of the aggregate material sequentially through said pre-heating/blending section, said heating/drying/mixing section, said heating/mixing section, and said discharge outlet;

a burner assembly extending from said second end into said heating/drying/mixing/ section for creating a high temperature gas stream flowing through said heating/drying/mixing section and said pre-heating/blending section; and tubular compartments in said heating/drying/mixing section defining a plurality of aggregate transporting channels extending through at least a portion said eating/drying/mixing section such that aggregate transporting channels within the tubular compartments are out of direct contact with the high temperature gas stream and said tubular compartments are exposed to said high temperature gas stream whereby said aggregate material can be heated indirectly by said high temperature gas stream as the aggregate material passes through the aggregate transporting channels, the tubular compartments being arranged to define a combustion chamber to receive said high temperature gas stream produced by said burner assembly; and a flue gas diverter positioned adjacent the combustion chamber to form an exhaust passageway separate from said combustion chamber.

27. The drum mixer of claim 26, wherein the flue gas diverter includes slots to pass a portion of said high temperature gas stream directly from said combustion chamber to said exhaust passageway.

* * * * *

UNITED STATES PATENT AND TRADEMARK OFFICE

CERTIFICATE OF CORRECTION

PATENT NO. : 6,267,493 B1
DATED : July 31, 2001
INVENTOR(S) : George W. Swisher, Jr. and Jianmin Zhang It is certified that error appears in the above-identified patent and that said Letters Patent is hereby corrected as shown below:

Column 7,
Line 47, delete “rust” and substitute therefor -- an exhaust --;

Column 12,
Line 11, delete “portion said eating/” and substitute therefor
-- portion of said heating/ --.

Signed and Sealed this

Twenty-second Day of April, 2003

JAMES E. ROGAN
*Director of the United States Patent and Trademark Office*